US008450936B1

(12) United States Patent
Stopa

(10) Patent No.: US 8,450,936 B1
(45) Date of Patent: May 28, 2013

(54) DUAL RANGE POWER SUPPLY

(75) Inventor: James L. Stopa, Old Saybrook, CT (US)

(73) Assignee: Whelen Engineering Company, Inc., Chester, CT (US)

( * ) Notice: Subject to any disclaimer, the term of this patent is extended or adjusted under 35 U.S.C. 154(b) by 334 days.

(21) Appl. No.: 12/779,535

(22) Filed: May 13, 2010

(51) Int. Cl.
*H05B 37/02* (2006.01)

(52) U.S. Cl.
USPC ..... 315/209 R; 315/291; 315/169.1; 315/185 S; 315/294; 315/307

(58) Field of Classification Search
USPC ..... 315/209 R, 224, 225, 291, 307; 363/34, 363/50, 52, 55, 56.02, 58, 79, 108
See application file for complete search history.

(56) References Cited

U.S. PATENT DOCUMENTS

| | | | | |
|---|---|---|---|---|
| 4,007,378 | A | 2/1977 | Lazzara | |
| 4,603,289 | A | 7/1986 | McLellan | |
| 4,779,037 | A | 10/1988 | LoCascio | |
| 5,430,600 | A | 7/1995 | Burns | |
| 6,586,890 | B2 | 7/2003 | Min et al. | |
| 6,653,789 | B2 | 11/2003 | Roller et al. | |
| 6,836,081 | B2 | 12/2004 | Swanson et al. | |
| 2009/0021182 | A1 | 1/2009 | Sauerlaender | |
| 2009/0195180 | A1 | 8/2009 | Chenetz | |
| 2010/0060175 | A1 * | 3/2010 | Lethellier | 315/164 |

* cited by examiner

*Primary Examiner* — Shawki Ismail
*Assistant Examiner* — Christopher Lo
(74) *Attorney, Agent, or Firm* — Alix, Yale & Ristas, LLP

(57) ABSTRACT

The disclosed power supply is compatible with two voltage ranges, the midpoint or mean of the higher voltage range being approximately double the midpoint or mean of the lower voltage range. Two equivalent loads and two current sources are re-configured using a relay in response to a detected input voltage exceeding a pre-determined threshold voltage. The disclosed circuit re-configures the load being driven to match the input voltage, rather than re-configuring the voltage to match the load.

19 Claims, 1 Drawing Sheet

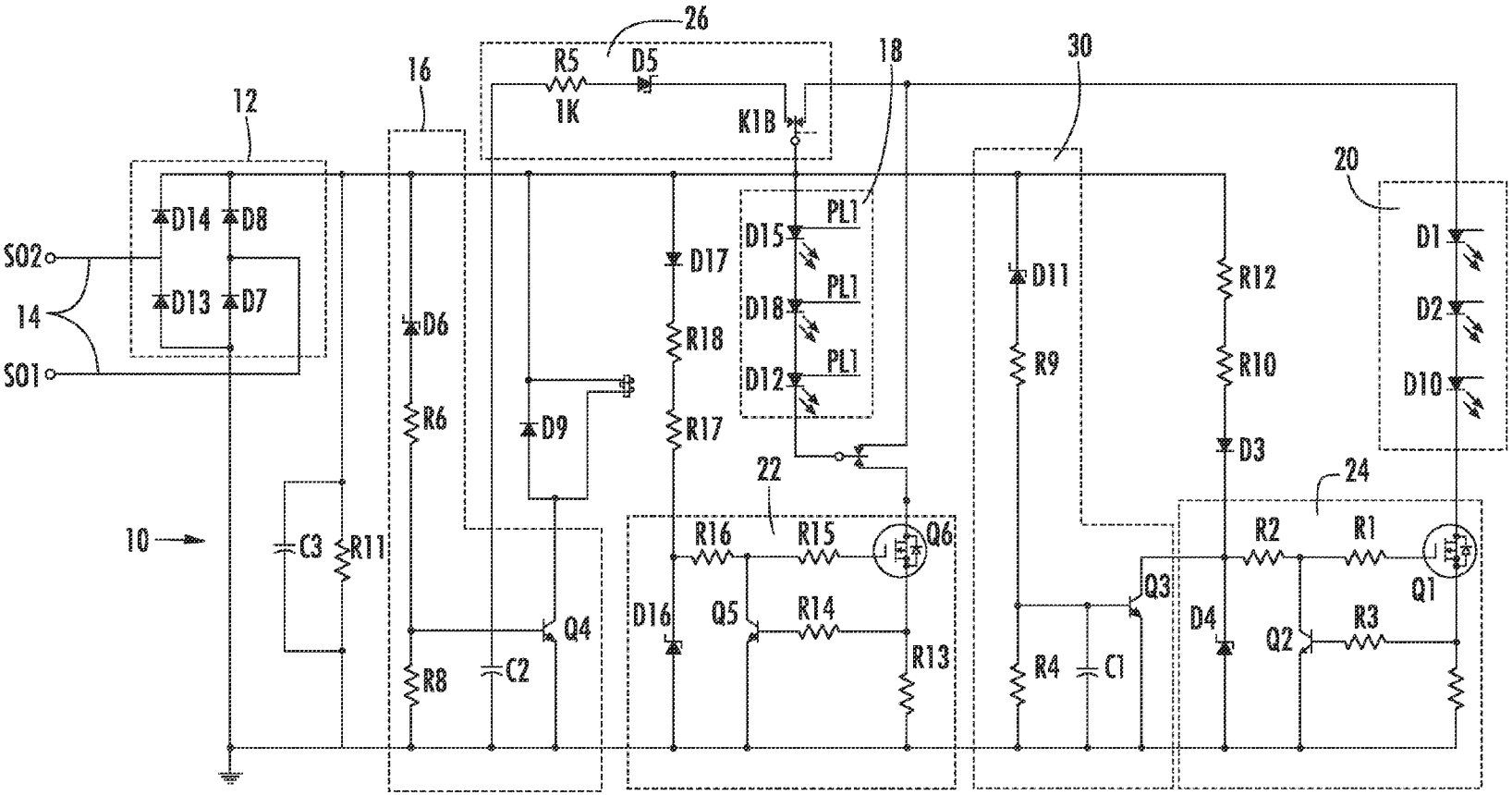
D1
D2
D10
20
Q1
R1
R3
24
R2
Q2
R12
R10
D3
D4
Q3
C1
30
D11
R9
R4
Q6
R13
18
PL1
PL1
PL1
R15
R14
D15
D18
D12
22
K1B
R16
Q5
D17
R18
R17
D16
26
D5
R5
1K
D9
Q4
C2
16
D6
R6
R8
R11
C3
12
D8
D7
D14
D13
10
SO2
14
SO1

DUAL RANGE POWER SUPPLY

BACKGROUND

Commercial, emergency, military and passenger vehicles commonly employ direct current (DC) electrical systems operating at voltages of 12 volts or 24 volts DC. It is common for manufacturers to produce electrically driven subassemblies for each voltage range, e.g., a 12 volt product and a 24 volt product. A power supply for use with a known voltage source is typically simple and inexpensive. Alternatively, products designed for use with a wide range of voltages are provided with "switching" power supplies that transform the available voltage using known "buck", "boost", "sepic or "buck boost" topology circuit configurations. Switching power supplies are more complex and expensive than a simple DC power supply. Switching power supplies use high speed switching of a transistor and typically generate undesirable RF noise which then must be filtered or suppressed by shielding.

There is a need for a simple and inexpensive power supply circuit for motor vehicle electronic sub-assemblies that will allow the electronic sub-assembly to be used with both common motor vehicle voltage ranges.

There is a need for a simple and inexpensive power supply circuit for motor vehicle electronic subassemblies that does not generate RF noise.

SUMMARY

The disclosed circuit is compatible with the 12 volt and 24 volt electrical systems commonly found in motor vehicles. Motor vehicle electrical systems experience significant variation in available voltage depending upon a number of factors, including the state of the vehicle battery, whether the vehicle is running or not, and the electrical load applied to the electrical system. For a 12 volt DC motor vehicle electrical system, the voltage may vary between 11 and 16 volts. For a 24 volt electrical system, the voltage may vary between 22 volts and 32 volts. The disclosed circuit is configured to be compatible with both of these voltage ranges. This is accomplished by employing a relay driven by a threshold voltage detector to reconfigure the load when the applied voltage exceeds a threshold voltage, indicating the circuit is connected to a vehicle employing a 24 volt electrical system.

In the disclosed circuit, the load being driven includes two series strings of light emitting diodes (LEDs). LEDs are current-driven devices, so the disclosed circuit includes a pair of substantially equivalent current sources configured to provide regulated current through the LEDs. When the circuit is connected to a 12 vDC electrical system, the relay remains in its de-energized state and the relay contacts connect each string of LEDs between the input voltage and a current regulator. When the circuit is connected to a 24 VDC electrical system, the input voltage exceeds the threshold voltage and the circuit energizes the relay, re-configuring the circuit so that the two strings of LEDs are in series with each other between the input voltage and one of the current sources. In each configuration, the LEDs drop most of the input voltage, with the remainder dropped across a field effect transistor (FET) or bipolar transistor, which regulates current through the LEDs. The disclosed circuit re-configures the load being driven to match the input voltage, rather than re-configuring the voltage to match the load.

BRIEF DESCRIPTION OF THE FIGURE

FIG. 1 is a schematic diagram of an embodiment of the disclosed dual range power supply circuit.

DETAILED DESCRIPTION

FIG. 1 illustrates a power supply circuit 10 which allows the same electronic subassembly to be compatible with 12 volt or 24 volt motor vehicle electrical systems. The disclosed power supply circuit is illustrated in the context of an LED light, but may be compatible with other electronic subassemblies.

A low voltage loss bridge rectifier 12 at the input 14 provides reverse polarity protection and bi-directional input voltage capability, similar to a standard incandescent bulb. An input voltage threshold detector 16 includes a Zener diode D6 connected in series with a resistor voltage divider R6, R8. The base of a transistor Q4 is connected to the voltage divider R6, R8 so that when the voltage applied to the input exceeds the Zener diode D6 breakdown voltage (referred to as the threshold voltage), the transistor Q4 is turned on. Transistor Q4 conducts, applying voltage to the coil K1C of relay K1. Relay K1 has two pairs of contacts K1A and K1B, which remain in the de-energized or first position shown in FIG. 1 when the voltage at input 14 (the input voltage) is below the threshold voltage set by Zener diode D6, Q4 is turned off and voltage is not applied to the coil K1C of relay K1. When the input voltage exceeds the threshold voltage set by Zener diode D6, Q4 is turned on and voltage is applied to the coil K1C, which switches the relay contacts from the de-energized state (first position) shown in FIG. 1 to the energized state (second position).

As shown in FIG. 1, the de-energized contacts of relay K1 place the LED loads 18, 20 between the input voltage and their respective current sources 22, 24. When relay K1 is energized, the relay contacts K1A and K1B change state. In the energized state, relay contact K1A connects the first LED load 18 in series with the second LED load 20 which is in turn connected to the second current source 24. In the energized state, relay contact K1B disconnects the input voltage from the second LED load 20 which is now instead connected in series with the first LED load 18 by relay contact K1A. In this manner, the disclosed power supply circuit 10 re-configures the load to match the input voltage.

In the disclosed circuit, three of the selected high power white LEDs drop most of an input voltage in the 11-16 volt range, with the remainder being taken up by the current source FET Q6, Q1. The disclosed circuit operates the FED in linear mode and since the voltage drop across the load 18, 20 is matched to the input voltage, the FED can operate in a relatively efficient near-saturation mode. If one of the disclosed LED loads 18 or 12 and a current source 22 or 24 were connected to an input voltage in the higher range (22 v-32 v), voltage not dropped over the LED load would be dropped across the current source FED Q6, Q1. This mode of FET operation would be very inefficient, causing excess power to be dissipated by the FET and likely causing overheating of the transistor Q6, Q1. Six of the selected LEDs are a better match for the higher voltage range (22 v-32 v), leaving a much smaller voltage to be dropped across the current source FET Q6, Q1 so that a majority of power consumed by the assembly is used to generate light from the LEDs in loads 18, 20.

The circuit of FIG. 1 is configured to detect the applied input voltage and generate a signal when the input voltage exceeds a predetermined threshold voltage. In the disclosed circuit, the predetermined threshold voltage is selected to be greater than the highest voltage typically generated in a 12 volt motor vehicle electrical system, e.g., approximately 18 volts. The disclosed voltage detector includes a Zener diode D6 in series with a resistance voltage divider R6, R8. When the applied voltage exceeds 18 volts, the Zener diode D6 breaks down and begins to conduct, sending current through the resistors R6 and R8, which generates a voltage at the junction of R6 and R8. This threshold voltage signal at the junction of R6 and R8 turns on a transistor Q4 which applies input voltage to the coil K1C of relay K1, causing the relay contacts K1A, K1B to change from their de-energized (first) state to their energized (second) state. Relay contact K1A changes state, disconnecting the first LED load 18 from its current source 22 and connecting the first LED load 18 in series with the second LED load 20. Relay contact K1B changes state, disconnecting input power from the second LED load 20 and connecting input power to a latch circuit 26. The latch circuit 26 includes a 17 volt Zener diode D5 in series with a resistor R5 and a capacitor C2. This latching circuit maintains transistor Q4 turned on so long as the input voltage is above 17 volts. The disclosed voltage detector 16 and latch circuit 26 ensure that once the input voltage rises above 18 volts and relay K1 is energized, transistor Q4 will remain turned on and the relay K1 will remain energized until the input voltage falls below 17 volts. This circuit configuration prevents bouncing or chatter of the relay during start up and shut down of the circuit, which can diminish the life span of the relay K1.

Each current source includes a FET Q6, Q1 and a transistor Q5, Q2 arranged to regulate current through the FET. It should be noted that the regulating transistors Q2 and Q5 and the current source FETs Q6, Q1 are arranged on the same printed circuit (PC) board as the LED loads 18, 20 in the disclosed circuit configuration. The selected regulating transistors are temperature sensitive, so that increasing temperature causes a reduction in current through the FET and the LEDs. This arrangement exposes the current regulators 22, 24 to the same temperature as the LED loads 18, 20 and automatically reduces current through the LEDs when the assembly temperature approaches temperatures which could damage the LEDs.

The disclosed circuit 10 also includes a high voltage shutdown 30, which employs a 36 volt Zener diode D11 and voltage divider R9, R4. Input voltage in excess of 36 volts causes Zener diode D11 to break down and conduct, resulting in voltage at the junction of R9 and R4. This shutdown voltage at the junction of R9 and R4 turns on transistor Q3, which effectively grounds the gate of Q1, shutting off the second current source FET Q1 when the input voltage exceeds 36 volts. This prevents the circuit from being damaged by high voltages.

The disclosed circuit 10 provides a protected and durable electronic assembly which can be installed in 12 or 24 volt vehicle electrical systems, eliminating the need to manufacture separate assemblies compatible with these voltages.

An embodiment of the disclosed power supply is described with reference to the drawing. Variations of the disclosed embodiment may become apparent to those skilled in the art upon reading the foregoing description. The appended claims are intended to encompass all modifications, variations and equivalents of the disclosed subject matter.

The invention claimed is:

1. A power supply for use with first and second input voltage ranges to provide power to first and second loads, each of said voltage ranges having a minimum voltage and a maximum voltage, the minimum voltage of said second input voltage range being greater than the maximum voltage of said first voltage range, said power supply comprising:

a power input where an input voltage is applied;

a threshold voltage detector responsive to the input voltage applied to said power input, said threshold voltage detector configured to detect a threshold voltage greater than said first voltage range maximum voltage and generate a threshold signal when exposed to said threshold voltage;

a latch circuit responsive to a latch voltage less than said threshold voltage but greater than said first voltage range maximum voltage to maintain said threshold signal so long as said latch voltage is present;

first and second current sources; and first and second electrical connections that change from a first state to a second state in response to said threshold signal, said first electrical contact connecting the first load and said first current source in said first state and connecting said first load in series with said second load in said second state, said second electrical contact connecting said input voltage to said second load in said first state and said input voltage to said latch circuit in said second state, wherein said first and second loads are connected between said input voltage and said first and second current sources, respectively, when said input voltage is less than said threshold voltage and said first and second loads are connected in series between said input voltage and said second current source when said input voltage is greater than said threshold voltage and said threshold signal is maintained and said first and second electrical connections remain in said second states so long as said input voltage is greater than said latch voltage.

2. The power supply of claim 1, comprising a relay responsive to said threshold signal to change the state of said first and second electrical connections, the first state of said first and second electrical connections corresponding to the de-energized state of said relay.

3. The power supply of claim 1, wherein said first and second loads comprise a plurality of LEDs connected in series.

4. The power supply of claim 1, wherein said first and second loads comprise an equal number of LEDs connected in series.

5. The power supply of claim 1, wherein said threshold signal energizes a relay to change the state of said first and second electrical connections from said first state to said second state, said latch circuit arranged to maintain said relay in the energized state until said input voltage falls below said latch voltage.

6. The power supply of claim 1, wherein said threshold voltage detector and latch circuit employ zener diodes to set the threshold voltage and latch voltage.

7. The power supply of claim 1, wherein said input voltage is always applied to said threshold voltage detector and said input voltage is applied to said latch circuit only after said threshold signal is generated.

8. The power supply of claim 1, wherein said threshold signal turns on an electronic switch which energizes a relay to change the state of said first and second electrical connections.

9. The power supply of claim 1, wherein each said constant current source includes a FET power transistor configured to deliver substantially constant current to said first and/or second loads.

10. The power supply of claim 1, wherein the first load and second load are series strings of LEDs, each series string having the same number of LEDs.

11. A method for providing power to first and second loads from an applied voltage having first and second voltage ranges, each of said voltage ranges having a minimum voltage and a maximum voltage, the minimum voltage of said second voltage range being greater than the maximum voltage of said first voltage range, said method comprising:

connecting a first voltage detector to said applied voltage, said voltage detector responsive to a threshold applied voltage greater than the maximum voltage of said first voltage range to generate said a signal, connecting said first load between said applied voltage and a current source and connecting said second load between said applied voltage and a current source in the absence of said first signal;

connecting said first and second loads in series with each other and connecting said series connected first and second loads between said applied voltage and a current source if said first signal is present, and when said first signal is present, connecting said applied voltage to a latch circuit constructed to maintain said first signal so long as said applied voltage is at least equal to a latch voltage greater than the maximum voltage of said first voltage range but less than said threshold applied voltage.

12. The method of claim 11, wherein said first and second loads are series connected pluralities of LEDs, each said LED having a forward voltage $V_f$ and said method comprises:

selecting said LEDs so that an applied voltage in said first voltage range is greater than the sum of the forward voltages $V_f$ of said plurality of LEDs in each series and an applied voltage in said second voltage range is greater than the sum of the forward voltages $V_f$ in both pluralities of LEDs.

13. The method of claim 11, wherein said steps of connecting comprise:

providing a relay having first and second pairs of electrical contacts, each pair of electrical contacts having a first state corresponding to the deenergized state of said relay and a second state corresponding to an energized state of said relay, said relay responsive to said first signal to switch said first and second pairs of electrical contacts from the first state to the second state;

using said first set of electrical contacts in said first state to connect said first load to a current source and said first set of electrical contacts in said second state to connect said first load in series with said second load; and using said second set of electrical contacts in said first state to connect said second load to said applied voltage and said second set of electrical contacts in said second state to connect said applied voltage to said latch circuit.

14. The method of claim 11, comprising:

selecting said first and second loads to have substantially equivalent voltage drops and wherein said second voltage range has a first mean voltage is approximately twice a second mean voltage of said first voltage range.

15. The method of claim 11, comprising:

regulating current through said current sources with a regulator including a transistor whose properties change with temperature, said transistor responding to an increase in temperature by decreasing current through said current sources; and placing said current sources and regulating transistors on a thermally conductive support in thermal contact with said first and second loads.

16. An LED driver circuit comprising:

an input where an input voltage is applied;

an input voltage switch responsive to an input voltage greater than a first predetermined voltage to generate a first signal;

first and second current sources;

a first LED load connected to said input voltage;

a second LED load connected to said second current source;

first and second sets of electrical connections, each set of electrical connections having first and second states and responsive to said first signal to switch from said first state to said second state, said first set of electrical connections connecting said first LED load to said first current source when in said first state and connecting said first LED load in series with said second LED load when in said second state, and said second set of electrical connections connecting said input voltage to said second LED load when in said first state and disconnecting said input voltage from said second LED load when in said second state.

17. The LED driver circuit of claim 16, comprising:

a latch circuit connected to said input voltage when said second set of electrical connections is in said second state, said latch circuit configured to maintain said first signal so long as said input voltage remains above a second predetermined voltage less than said first predetermined voltage.

18. The LED driver circuit of claim 17, wherein said input voltage switch and said latch circuit employ zener diodes to detect said first and second predetermined voltages.

19. The LED driver circuit of claim 16, wherein said first and second LED loads comprise series strings of LEDs.

* * * * *